US006227823B1

(12) United States Patent
Paul et al.

(10) Patent No.: US 6,227,823 B1
(45) Date of Patent: May 8, 2001

(54) COMPRESSED GAS DISPENSING STATION WITH HIGH PRESSURE COMPRESSOR WITH INTERNAL COOLED COMPRESSION

(76) Inventors: Marius A. Paul; Ana Paul, both of 20410 Via Canarias, Yorba Linda, CA (US) 92686

( * ) Notice: Subject to any disclaimer, the term of this patent is extended or adjusted under 35 U.S.C. 154(b) by 0 days.

(21) Appl. No.: 09/095,375

(22) Filed: Jun. 10, 1998

Related U.S. Application Data

(60) Provisional application No. 60/049,298, filed on Jun. 11, 1997.

(51) Int. Cl.[7] ..... F04B 23/00

(52) U.S. Cl. ..... 417/440; 417/228; 417/283; 417/303; 417/505

(58) Field of Search ..... 417/440, 505, 417/507, 228, 283, 303; 137/625.5

(56) References Cited

U.S. PATENT DOCUMENTS

| | | | | |
|---|---|---|---|---|
| 4,576,015 | * | 3/1986 | Crawford | 62/292 |
| 5,097,857 | * | 3/1992 | Mayhew | 137/1 |
| 5,674,053 | * | 10/1997 | Paul et al. | 417/228 |
| 5,716,197 | * | 2/1998 | Paul et al. | 417/228 |
| 5,769,610 | * | 6/1998 | Paul et al. | 417/228 |

* cited by examiner

*Primary Examiner*—Charles G Freay
*Assistant Examiner*—Cheryl J. Tyler
(74) *Attorney, Agent, or Firm*—Richard Esty Peterson

(57) ABSTRACT

A compressed gas dispensing station having a high pressure gas compressor with a cyclic control system for selective recirculation of cooled, ultra high pressure gas through the compression chamber after the end of the compression stroke for scavenging hot compressed gas from the compression chamber and providing a residual, partially-expanded replacement gas for the expansion stroke which is mixed with the incoming, new charge of gas for a cryogenic gas at the start of compression and a relatively low temperature gas at the end of compression for a single stage compressor. The cyclic control system times the opening and closing of two delivery valves for separate 4000 psi and a 3600 psi branches, the delivery valve for the 4000 psi branch also regulating recirculation of 4000 psi cooled gas through the compression chamber for the 3600 psi branch after the end of the compression stroke to cool the chamber and replace the hot residual compression gas with a cold expanded gas, which is further expanded in the expansion stroke. Compressed gas is collected and stored in two receiver tanks having different pressures for mixing and dispensing at a customer service station according to customer requirements.

10 Claims, 7 Drawing Sheets

COMPRESSED GAS DISPENSING STATION WITH HIGH PRESSURE COMPRESSOR WITH INTERNAL COOLED COMPRESSION

This invention is the subject of provisional application Serial No. 60/049,298, filed Jun. 11, 1997, entitled, "High Pressure Compressor with Internal Cooled Compressor". This invention further advances the implementation of our initial invention described in patent application Ser. No. 08/379,147 filed Jan. 27, 1995, entitled, "High Pressure Compressor With Internal Cooled Compression," now U.S. Pat. No. 5,769,610, issued Jun. 23, 1998.

BACKGROUND OF THE INVENTION

The invention utilizes a balanced, dual crank reciprocator of the type disclosed in our U.S. Pat. No. 5,674,053, issued Oct. 7, 1997, entitled, "High Pressure Compressor with Controlled Cooling During the Compression Phase," and U.S. Pat. No. 5,716,197, issued Feb. 10, 1998 entitled, "High Pressure Compressor with Internal Inter-Stage Cooled Compression having Multiple Inlets."

The present invention defines a gas compressor and dispensing station with a new and improved cyclic control system for high and ultra high pressure compressors. The compressor in this system is capable of achieving in one stage, ultra high pressure ratios of over 40/1. The invented system eliminates the need for multi-stage compressors, compressor assemblies, particularly for natural gas compressors, requiring delivery pressures of 3600–4000 psi, for NGV (natural gas vehicle) supply stations and natural gas line transportation systems.

This invention relates to a gas compressor with a new cyclic control system that is provided with a control module and sensors for controlling a group of electronically activated, electro-hydraulic valves for regulating pressurized gas flow through the compressor. The electro-hydraulic valves are selectively operated during the reciprocal cycle of the compressor in an electronic-loop of cycle control format for routing gas at two discrete pressures through separate circuits in the compressor.

In this specification, the system described in our provisional application is refined with the construction of the electro-hydraulic valves controlling flow of high pressure gases from the compressor to the respective high pressure gas receiving tanks being detailed.

The single-stage compressor of this invention is designed to be inexpensively fabricated and operated for alternate fuel vehicles. Natural gas is a relatively clean, burning fuel, and, comprised largely of methane, has advantages over other hydrocarbon fuels in minimizing production of the greenhouse gas, carbon dioxide. Although natural gas is relatively abundant, it has not been widely used as an alternate fuel for vehicles because of the lack of a distribution system. Many cities have an existing infrastructure of gas distribution lines for heating and cooking. However, these are relatively low pressure lines, 30–40 p.s.i. at the street. At this pressure, the gas volume for powering a vehicle is too large to provide the driving range deemed acceptable.

Pressurized gas vessels have been designed to contain natural gas at the high pressure necessary for the fuel capacity for the driving range desired in a reasonably sized bottle. One fueling alternative is to replace prefilled gas bottles at a refueling station. It is not economical, however to prefill bottles and deliver such prefilled bottles to fueling stations for exchange with customer bottles.

While bottles may be pre-filled on the site of the fueling station, this requires an on-site compressor, and, if a fueling station has an on-site compressor it may as well fill a customer's fuel bottle already in the customer's vehicle. For the fuel to be competitively priced compared with gasoline, the on-site compression system must be efficient and productive, requiring minimal storage of compressed gas.

The high pressure gas compressor of this invention utilizes a positive displacement compressor with an expansion gas scavenging of the residual gases in the compressor. By strategic timing of the gas flow in the compression and expansion cycle, gas can be compressed in a single stage with a resultant temperature well within the thermal limits of the structural components of the compressor.

The gas compression system of this invention is targeted toward the natural gas industry both for high pressure transportation of gas in gas lines, and for destination stations where natural gas is dispensed to customer bottles for use as a vehicle fuel. It is to be understood, however, that the gas compression system can be utilized for gasses other than fuel gas where a cost-effective, high-pressure compression is required.

SUMMARY OF THE INVENTION

The ultra high pressure gas compressor in the compressed gas dispensing station of this invention is characterized by a control system controlling two high-pressure, electro-hydraulic valves. One valve is a delivery valve for regulating a 3600 psi branch, and the second valve is a delivery and recirculation valve for regulating a 400 psi branch. The compressor is also provided with an automatic or electro-hydraulic intake valve for regulating gas intake into the compressor.

The compressor cycle starts with the intake and mixture of an initial remaining charge of precooled, expanded cryogenic gas injected at the end of the previous cycle, followed by the compression stroke achieving 4000 psi. Pressure is monitored by an electronic pressure transducer, which is informing an electronic control module (ECM), that controls the activation of the delivery recirculation valve (DRV). This valve (DVR) is provided with two channels, one conducting the high pressure relative hot gases through a check valve, into a 4000 psi cooled receiver tank, and the second channel conducting a recirculated cooled gas from the cooled receiver tank back into the compression chamber.

The recirculation process is started by the activation of the 3600 psi delivery valve, which produces a pressure drop in the compression chamber, which causes the opening of the recirculation check valve, controlling the exit of 4000 psi gas from the cooled receiver tank. In that moment, the scavenging process of purging the hot gases toward the 3500 psi branch, and replacing the displaced gas with cooled high pressure 4000 psi gases is accomplished.

The 40-1 expansion of the cooled and high pressure 4000 psi gas, that remains in the compression chamber, produces a very low temperature cryogenic gas, which is mixed with the new intake charge, producing a low temperature mixture, also cryogenic, at the start of the compression cycle. The compression stroke will produce at the end, a relatively low temperature, high pressure delivery gas for the single stage compression.

The result will be an equivalent of an isothermic compression cycle. The high pressure compressor of this invention is particularly adapted for use in a gaseous fuel dispensing station. The embodiments described in this specification are designed for natural gas, which is typically a mixture of hydrocarbon gases, primarily methane.

DETAILED DESCRIPTION OF THE PREFERRED EMBODIMENTS

Figure 1:
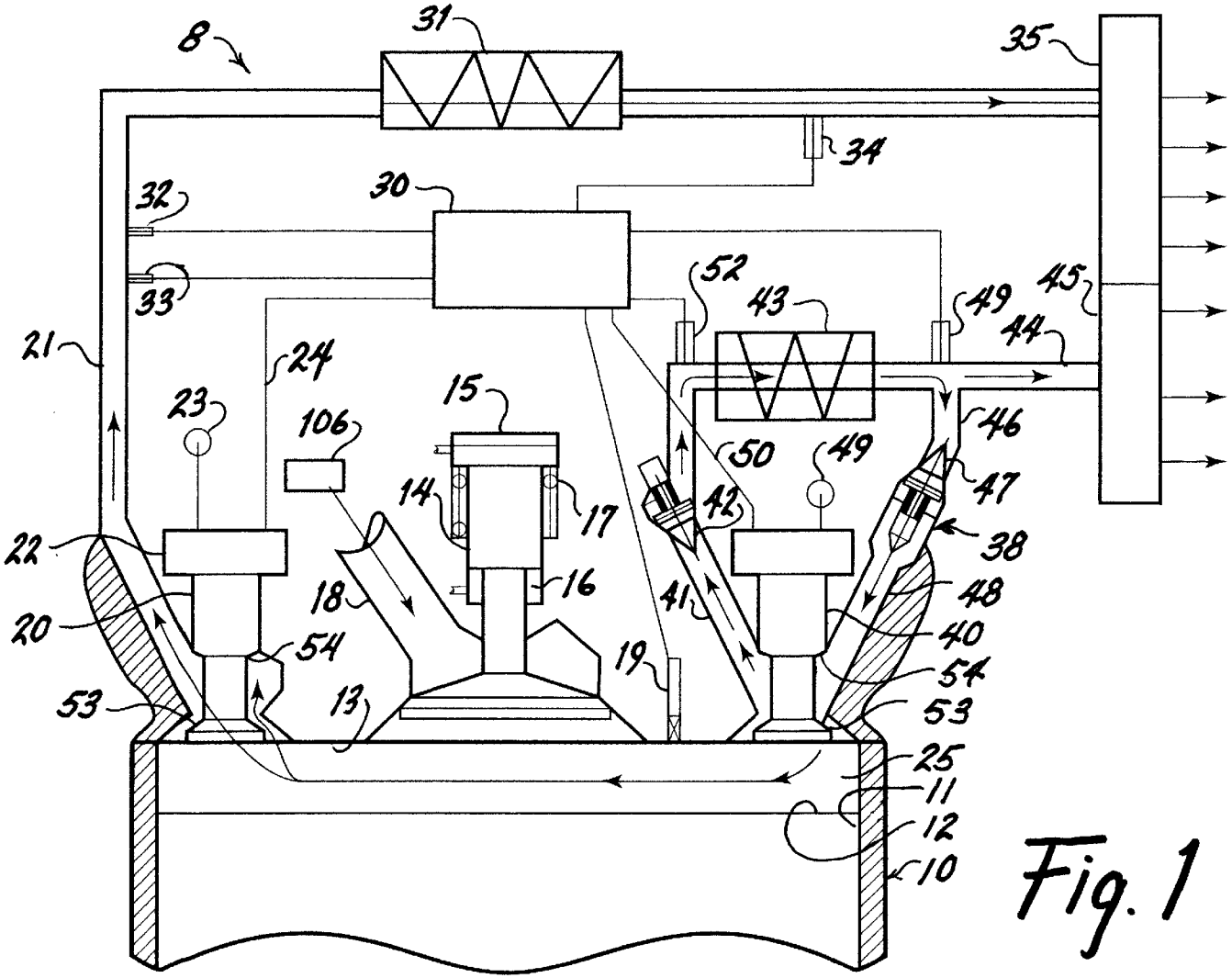
FIG. 1 is a schematic drawing of the compressor system with a cross section through the head and compression chamber of the compressor.

Referring to FIG. 1, a first embodiment of a high pressure gas dispensing station 8 featuring a single stage compressor 10 is schematically illustrated.

The compressor 10 has a cylinder 11, and a piston 12, and is provided with a cylinder head 13, having an intake valve 14, provided with two hydraulic stops 15 and 16 and a spring 17. The intake valve 14 regulates gas intake through an intake channel 18.

The compressor 10 is provided with a pressure transducer 19, facing the compression chamber 25 for monitoring the pressure in the compression chamber 25. The compressor is also provided with an electro-hydraulic discharge valve 20 for the 3600 psi delivery branch 21. The electro-hydraulic valve module 22, receives the hydraulic activation fluid from the hydraulic source 23, and an activating electronic control impulse through the wire 24 from the electronic control module 30.

The 3600 psi gas delivery branch delivers the gas to the cooled receiver tank 31, which includes a heat exchanger to reduce gas temperature to at least ambient temperature. The discharge valve 20 is controlled by the electronic control module with input from a pressure transducer 32 and a temperature transducer 33 for timely operation of the valve. A final temperature transducer 34, monitors the final temperature of the gas delivered to the gas dispenser 35.

The compressor 10 is also provided with a valving device 38 having an electro-hydraulic discharge and recirculation valve (HDRV) 40, controlling the 4000 psi gas for delivered and circulated gas. The valves 20 and 40 are designed for balanced pressure on the valve head shoulder 53 and stem shoulder 54 enabling rapid electro-hydraulic activation. The 4000 psi gas branch is provided with a discharge channel 41 controlled by a check (one way) valve 42, conducting the hot 4000 psi gas to the cooled receiver thank 43, which is similar to tank 31. The discharge and recirculation valve 40 is controlled by the control module 30 with input from the temperature transducer 52.

The electro-hydraulic discharge and recirculating valve 40 receives the hydraulic activation fluid from the source 49 and is electronically connected by the wire 50 with the electronic control module 30 for timely operation.

The cooled 4000 psi gas emerging from the cooled receiver tank 43, is conducted in the passage 44 toward the gas dispenser 45, and in the gas passage 46, toward the recirculation "one way" check valve 47, and through the recirculation channel 48, back into the port of the electro-hydraulic discharge and recirculation valve (EDRV) 40. The final temperature of the delivered gas (4000 psi) is monitored by the temperature transducer 49 and used as a control factor for regulation of the operation of the compressor by the control module 30.

The combined gas dispensers 35 and 45 form the gas dispenser cascade for the base station.

The compressor cycle control system starts from the moment is which the 4000 psi pressure is reached, close to the end of the compression stroke. The pressure is monitored by the pressure transducer 19, and the electronic control module 30 signals the activation of the electro-hydraulic discharge and recirculating valve 40, to discharge the 4000 psi hot gas, to the cooled receiver tank 43, through the one way check valve 42.

The electro-hydraulic discharge valve 20 is activated after an "angular/time" interval "A", opening the 3600 psi gas discharge branch 21, and producing a pressure drop in the compression chamber 51. In that moment, the check valve 42 is closed, and the check valve 47 is open, starting a flow of cooled 4000 psi gas recirculated from the cooled receiver 43, to the compression chamber 51, producing a "scavenging effect" of the hot gases, from the compression chamber 51, by the open electro-hydraulic discharge valve 20 to the 3600 psi delivery branch 21.

After an "angular-time" internal "B", the electro-hydraulic valve 20, is closed by a signal from the electronic control module 30, and after an "augular/time" interval "C", the compression chamber 51, is charged with 4000 psi cooled gas, and the electro-hydraulic discharge recirculation valve 40 is closed.

From the "moment C" to the end of the expansion stroke, the remnant gas in the compressor will have a cryogenic temperature producing an "internal cooling fluid of gas", which will be mixed with the new intake gases. Timing of the sequence is controlled by the electronic control module 30 for optimizing production of high pressure gas within safe operating temperature ranges.

The new mixed gas, at the beginning of the compression, will have a very low temperature approaching a cryogenic level, resulting at the end of the compression stroke, in a final relatively low temperature for the delivered high pressure gas.

The general compression cycle can be considered an approximation of an isothermic compression cycle, with the lowest energy consumption, obtained in "one single compression stage".

Figure 2:
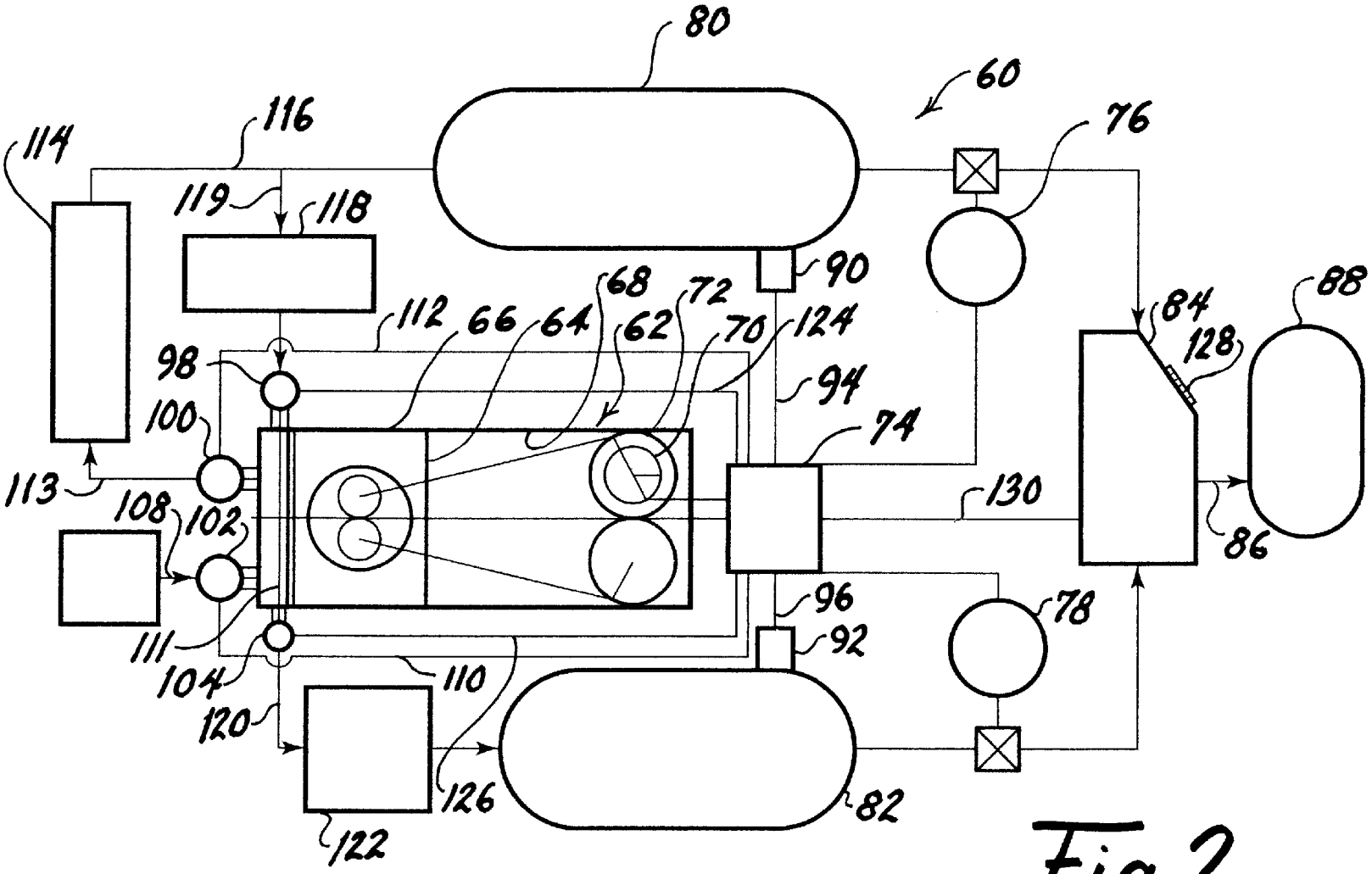
FIG. 2 is a schematic drawing of an alternate configuration of the compression system showing a customer's fuel bottle.

Referring now to FIG. 2, a second embodiment of a high pressure gas dispensing station 60 is schematically illustrated. The dispensing station 60 includes a single-stage gas compressor 62 that utilizes a dual-crank piston assembly 64 that provides a dynamic balance which eliminates side forces of the piston 66 again the cylinder 68. This enables the ultra high pressures in the range of 4000–5000 to be obtained in a single stage. However, because of the temperature generated in a gas compression of this magnitude, an internal cooling is required to reduce the temperature of the discharged gas to a level within the thermal limits of the system components. Key to the internal cooling is the admission of high pressure cooled gas at the completion of the compression cycle to scavenge residual hot gases and replace the displaced gases with a high-pressure partially expanded gas that cools to cryogenic levels when further expanded during the expansion cycle. Because a portion of the product compressed gas is used for cooling, precise timing of the sequencing is required to maintain efficiencies of the system.

System timing is effectively controlled by an encoder 70 that is connected to one of the two crank shafts 72 that feeds a cycle phase signal to a central electronic module 74 that is the universal electronic processor and controller for the dispensing station. It is understood that separate control systems may be employed for the tasks of compressing the gas and dispensing the gas.

The central electronic control module 74 receives signals from a variety of sensors and controls the operation of the various electronic components. Because of the partial compressibility of control fluids utilized as an actuating medium and the compressibility of gases in the system, a system program is utilized by the internal processor of the central electronic control module to continually adjust the system to obtain the desired effect of the timed events. The electro-hydraulic regulating valves are designed for precision operation with minimum reaction time and minimized after effects.

In the system of FIG. 2, two gas pressure regulator valves 76 and 78 control the discharge of pressurized gas from two storage tanks 80 and 82 maintained at a differential pressure to achieve the cooling objectives of the system during compression. The dispensing station 60 has a pressurized dispenser 84 with a high-pressure gas line 86 that connects to a customer's high-pressure gas bottle 88 that may remain in the customer's vehicle (not shown). The use of both a high pressure storage tank 80 and a lower pressure storage tank 82 allows a depleted bottle to be filled first with the lower pressure gas before being topped with the higher pressure gas to the ultimate pressure required by the customer. In this manner, high pressure gas is conserved for final pressurization and in certain instances may not be used for those customers with only lower pressure requirements.

It is to be understood that in a gas transportation system, the dispenser 84 is not used and the gas pressure regulator valves 76 and 78 are used to maintain a mix with the desire line pressure in the range between the lower pressure gas in the storage tank 82 and the higher pressure gas in the storage tank 80. The pressures in the respective tanks 80 and 82 are pre-determined by the system user within certain parameters to insure that for a given high pressure, the differential is sufficient to allow for internal cooling as described. For example, the high pressure tank may be maintained at 20% higher pressure than the lower pressure tank to provide an adequate margin for expansion cooling. The set pressures are maintained by pressure transducers 90 and 92 for the tanks 80 and 82, respectively. The transducers sense the respective pressure and transmit electrical signals through lines 94 and 96 to the control module 74. After processing, the control module 74 regulates the operation of the compressor 62 to maintain the tanks within the acceptable storage range and differential pressure.

Operation of the compressor 62 is substantially the same as for the compressor 10 in the previously described embodiment. Regulating the operation of the compressor 62 is accomplished by four electro-hydraulic valves 98, 100, 102, and 104. The gas admission valve 102, is not required to perform at the higher pressures and therefore need not have the complexity of the other valves which preferably have an identical construction, as detailed in FIGS. 3–7. Alternatively, the valve construction as detailed can be used with check valves as a dual valve in the embodiment of FIG. 1.

In operation low pressure gas from a gas source 106 is admitted through intake conduct 108 by electro-hydraulic valve 102 under control of the control module 74 through electronic control line 110. The gas is compressed on closure of the valve 102 by the piston 66 of the compressor 62. At the cycle phase that the pressure in the diminishing compression chamber 111 reaches the pressure in the high pressure storage tank 80, the valve 100 is opened under control of the control module 74 through line 112, discharging the hot compression gases through outlet conduit 113 and intercooler 114 to storage tank 80 through conduit 116. Part of the discharged gas to conduit 116 is diverted to a second cooler 118 through conduit 119, which may advantageously be chilled by otherwise wasted cooling during expansion of gases at the dispenser during customer service.

After discharge of the high pressure gas and at the initiation of the expansion of the expansion stroke, the valve 100 under control of the control 74 is closed and electro-hydraulic valves 98 and 104 arranged on opposite sides of the compression chamber 111 are simultaneously opened scanvening the hot gases in the clearance volume remaining in the compression chamber 111. The scavenged gases are discharged through conduit 120 through cooler 122 to the receiving storage tank 82. Left in the clearance volume of the compression chamber 111 are the cooled gases from cooler 118, further cooled by the expansion to the secondary pressure maintained in the storage tank 82. As the expansion stroke of the piston 66 begins, electro-hydraulic valves 98 and 104 controlled by control module 74 through lines 124 and 126 are closed, allowing the pre-cooled trapped gases to expand to cryogenic levels (minus 250 degrees F.) to mix with the new charge on opening of the electro-hydraulic valve 102. In this manner the mixture can be prechilled to a low temperature (approximately minus 120 degrees F.) before compression.

Since the charge of gas is prechilled before compression, the peak pressure can be well within design limits of the conventional materials used for high pressure compressors. Since the compressor 62 is operated on-site with the dispenser, the storage tanks 80 and 82 can be of minimal size with the dispenser monitored by the control module 74.

A customer request input through a control panel 128 on the dispenser 84 is transmitted through input line 130 to the control module 74. The control module 74 processes the entry which may be a pressure limit for the customer's bottle 88, and operates the electronically controlled gas pressure regulator valves 76 and 78 to efficiently achieve the desired pressure. The dispenser 84, may include the necessary flow meters to calculate the quantity of gas dispensed and the charge to the customer.

Figure 3:
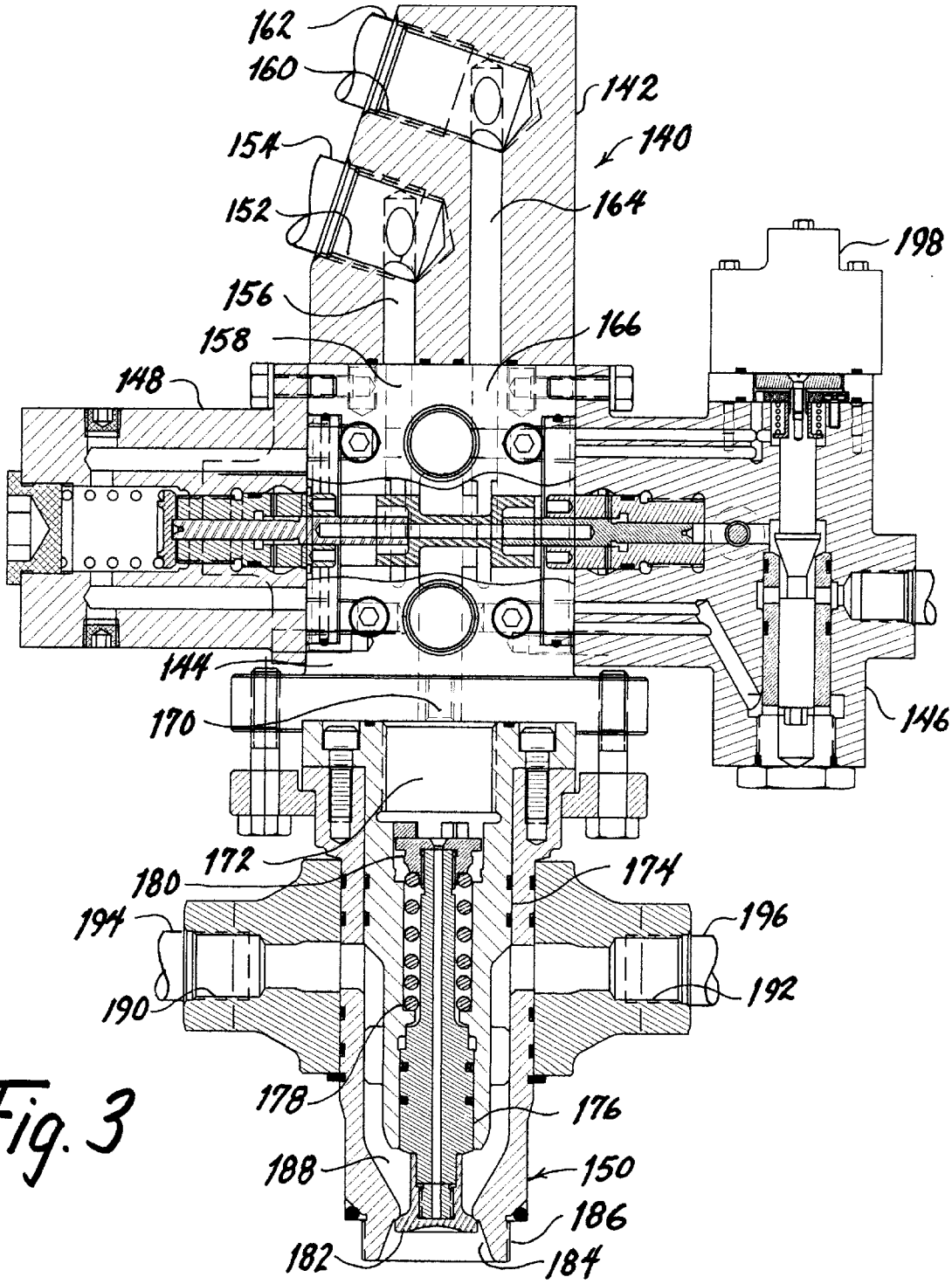
FIG. 3 is a cross-sectional view of a typical electro-hydraulic gas valve assembly for operation under ultra high pressures.

In order to instantaneously respond to the commands of the programmed control module, in the ultra high pressure environment of the compression chamber at peak pressure, at least the valves 98, 100, 104 have the modularized construction as shown in FIG. 3, where a typical electro-hydraulic valve unit 140 is shown.

Figure 4:
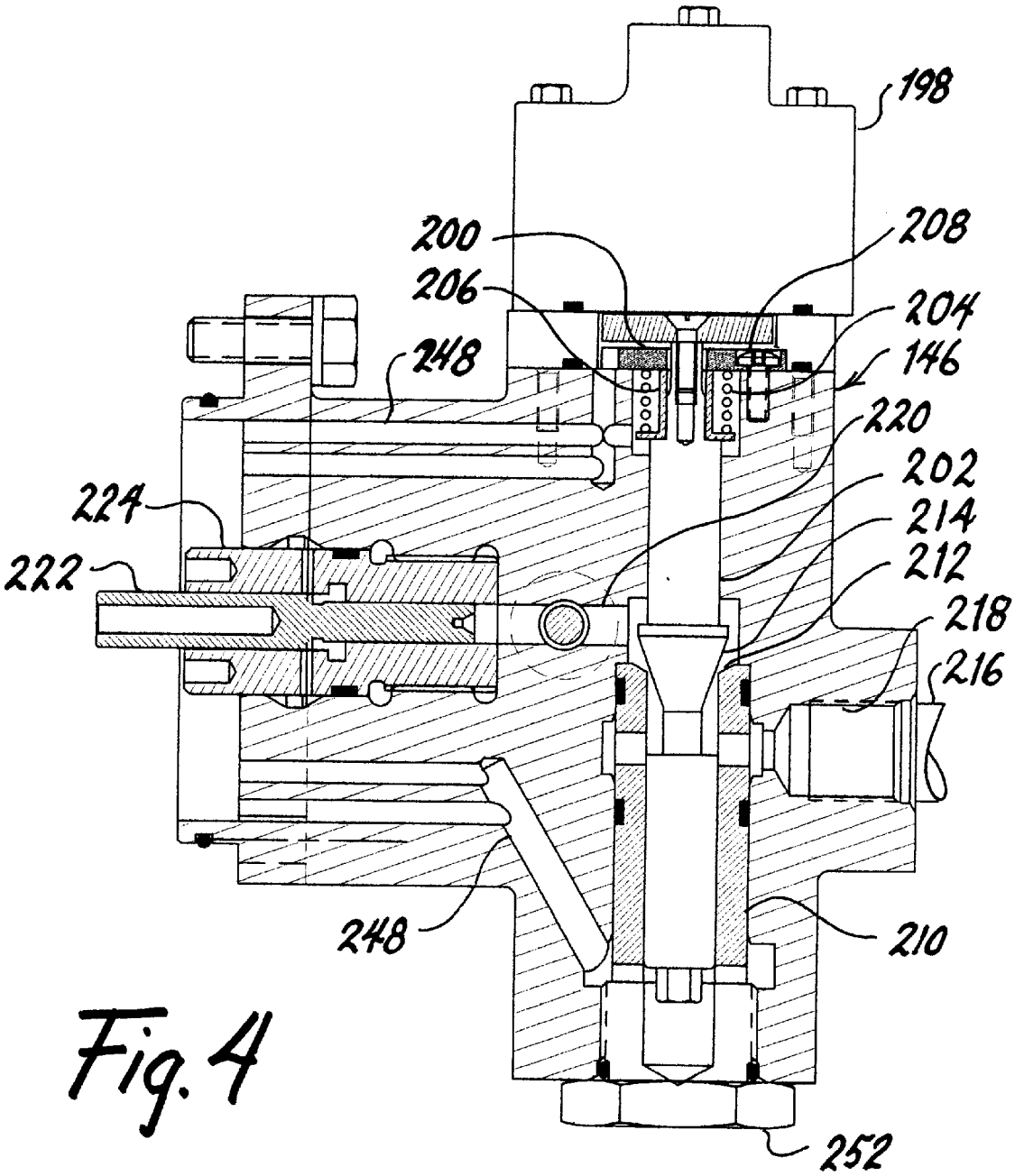
FIG. 4 is a cross-sectional view of the actuator control module in the assembly of FIG. 3.
Figure 5:
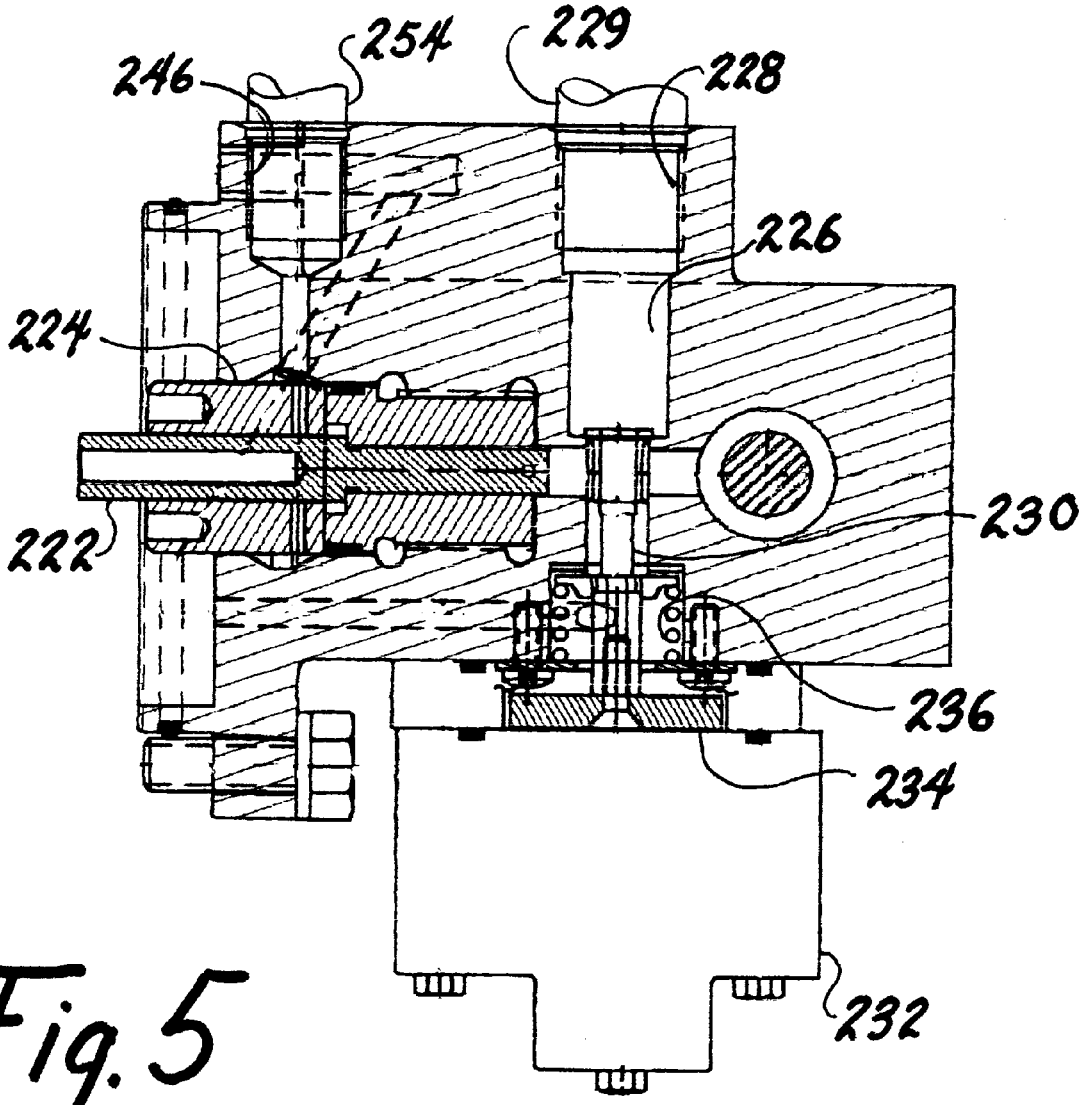
FIG. 5 is a cross-sectional view of the control module taken on a horizontal plane through the piston pusher in FIG. 4.
Figure 6:
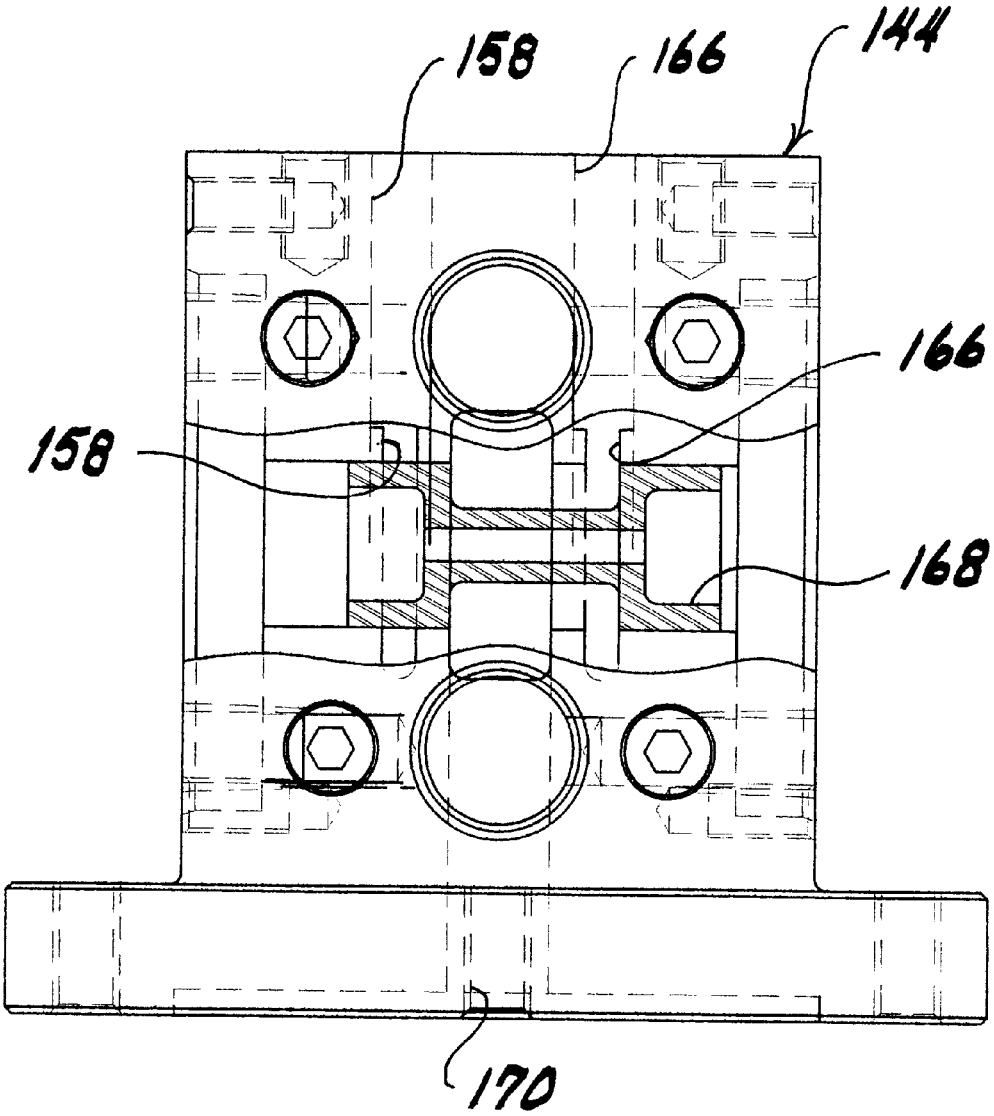
FIG. 6 is a cross-sectional view of the control spool valve module in the assembly of FIG. 3.
Figure 7:
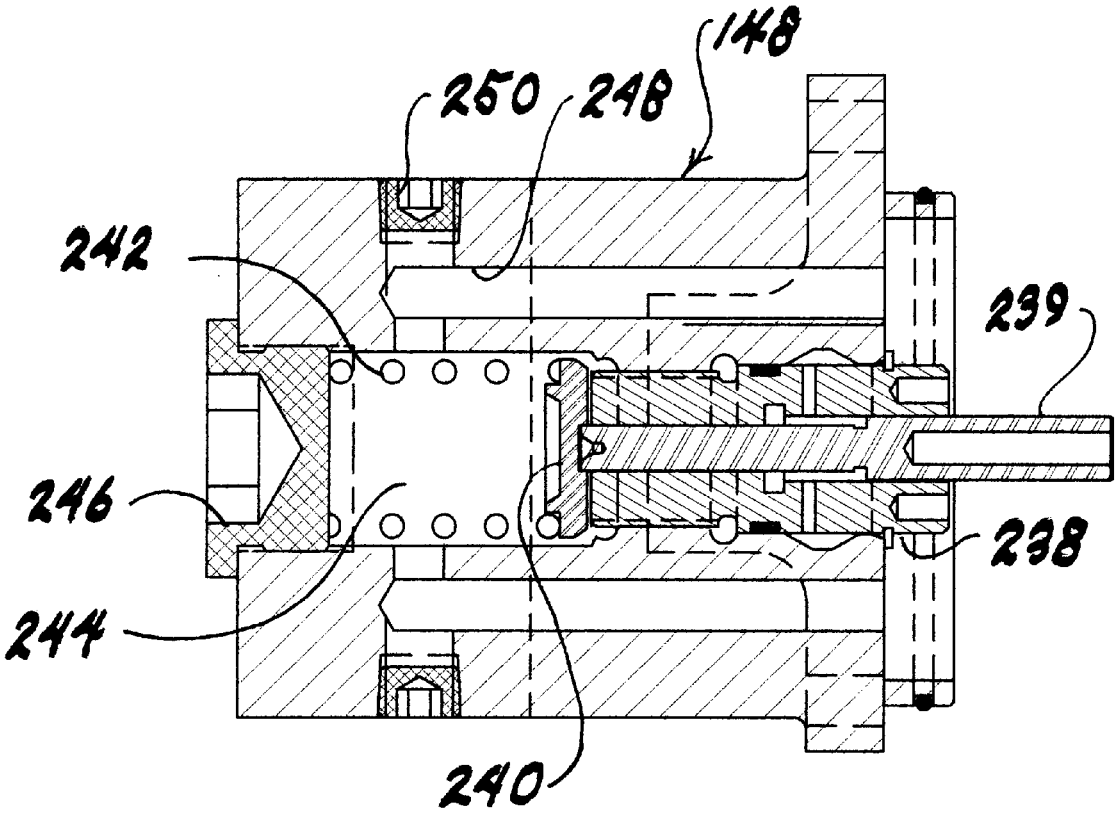
FIG. 7 is a cross-sectional view of the spring return module in the assembly of FIG. 3.

The electro-hydraulic valve unit 140 is an assembly of five modules, a hydraulic connector block 142 for the main hydraulic activation lines; a central spool valve block 144, detailed in FIG. 6; an actuator control block 146, detailed in FIGS. 4 and 5; a spring return block 148 detailed in FIG. 7; and, the main valve block 150.

As shown in FIG. 3, the hydraulic connector block 142 has a high pressure intake port 152 connecting a high pressure hydraulic feed conduit 154 to an internal passage 156 that communicates with an internal passage 158 in the coupled spool valve block 144. The hydraulic connector block 142 also has a low pressure return port 160 connecting a low pressure return conduit 162 to an internal passage 164 that communicates with an internal passage 166 in the spool valve block 144.

The spool valve block 144 has a displaceable spool valve 168 shown in a neutral position in the breakaway portion of the block 144 in FIG. 6, blocking both the hydraulic fluid delivery passage 158 and the return passage 166 to a common passage 170. The common passage 170 communicate with a piston chamber 172 in the main valve block 150 when the spool valve block 144 and main valve block 150 are coupled as shown in FIG. 3.

The main valve block 150 has an internal bushing 174 that guides a displaceable poppet piston 176 and contains a return spring 178 retained by a spring retainer 180 that biases a valve head 182 to a seated, closed position at the valve port 184 on the connector and 186 of the valve block 150. The connector end 186 connects with the compressor 62 with the valve port 184 in communication with the compression chamber 111.

Displacement of the poppet piston 176 by hydraulic fluid in the chamber 172 opens an internal gas passage 188 to the compression chamber for communicating ports 190 and 192 and gas conduits 194 and 196 to the compression chamber 111.

Controlling the spool valve 168 and hence the hydraulic actuation and return of the valve head 182 is actuator control block 146 shown in FIGS. 4 and 5. The control block 146 has a connected solenoid actuator 198 that an electronic actuator by the control module 74 attracts a displaceable armature plate 200 connected to a plunger valve 202 biased to closure by a compression spring 204 retained between a stroke limiter 206 and cap plate 208. The plunger valve 202 is guided by a bushing 210 having a valve seat 212 on which a valve shoulder 214 seats during closure, blocking a high pressure hydraulic conduit 216 connected to feed port 218. Feed port 218 connects an internal passage 220 to a piston pusher 222 displaceable in a bushing 224 when the plunger valve 202 is electronically actuated unseating the valve shoulder 214 from the valve seat 212. The displaceable piston pusher 222 is connected to the spool valve 168 in the assembly of FIG. 3.

As shown in FIG. 5 the internal passage 220 to the piston pusher 222 has a relief passage 226 to a relief port 228 connected to a hydraulic fluid return conduit 229. The relief passage 226 is blocked by a poppet valve 230 on actuation of a solenoid actuator 232 which attracts an armature plate 234 connected to a poppet valve 230 against the action of a spring 236 that on deactivation of the solenoid actuator 232 biases the valve 230 to an open position.

Referring to FIG. 7 the spring return block 148 has a bushing 238 for guiding a spring actuated pusher 239 that is connected to the opposite end of the spool valve 168 when the spring return block 148 is connected to the spool valve block 144 as shown in FIG. 3. The spring actuated pusher 239 is connected to a spring retainer 240 which retains a compression spring 242 in a cavity 244 capped by end cap 246. The modules 146 and 148 have various bleed passages 248, such as those capped by set screws 250 in the spring return block and the end cap 252 in the actuator control block 146 shown in FIG. 4. The bleed passages 248 return hydraulic fluid to the hydraulic return conduit 254 at the bleed line port 256 in the actuator control block 146.

The dual solenoid actuators 198 and 232 are actuated when it is desired that high pressure hydraulic fluid pass from conduit 216 to piston pusher 222 to displace spool valve 168 against spring 242. This allows high pressure hydraulic fluid from the conduit 154 to pressure chamber 172 displacing poppet piston 176 unseating valve head 182 allowing gas flow into or out of the compression chamber.

When deactivated, relief passage 226 is opened providing a sharp cut-off of the control fluid, allowing the return spring 242 to shuttle the spool valve 168 to a position that closes hydraulic feed passage 158, opening return passage 166 and closing the poppet valve head 182 by action of the spring 178.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A high pressure gas compression system comprising:

a gas source with a gas supply;

a high pressure piston compressor having a cylinder with a reciprocating piston in part forming a compression chamber, the reciprocating piston having cycle phases including a compression phase and an expansion phase;

a first compressed gas storage tank having pressure control means for controlling the pressure in the first tank at a first pressure;

a second compressed gas storage tank having pressure control means for controlling the pressure in the second tank at a second pressure lower than the first pressure;

a central electronic control module electronically connected to the pressure control means of the first storage tank and to the pressure control means of the second storage tank;

an electro-hydraulic valve system with a first electro-hydraulic valve electronically connected to the control module with valve means for admitting gas to the compression chamber on actuation by the control module;

a second electro-hydraulic valve, electronically connected to the control module with valve means for passing compressed gas from the compression chamber to the second tank on actuation by the control module;

a third electro-hydraulic valve, electronically connected to the control module with valve means for passing compressed gas from the compression chamber to the first tank on actuation by the control module, and a valving device with valve means for passing compressed gas at the first pressure through the compression chamber to the second storage tank to scavenge the compression chamber.

2. The gas compression system of claim 1 wherein the valving device includes a set of first and second check valves, wherein the third electro-hydraulic valve has an associated first valve passage with a first check valve blocking flow to the compression chamber and a second valve passage with a second check valve blocking flow from the compression chamber.

3. The gas compression system of claim 2 wherein cooled high pressure gas is supplied to the compression chamber through the second valve passage.

4. The gas compression system of claim 2 wherein the gas compression system has the first valve passage connected to the first storage tank with the valve passage having cooling means.

5. The gas compression system of claim 1 wherein the valving device comprises a fourth electro-hydraulic valve electronically connected to the control module with valve means for passing cooled gas at the first pressure to the compression chamber on actuation by the control module.

6. The gas compression system of claim 5 wherein the electronic control module has associated encoder means for timing the cycle phases of the piston in the compressor.

7. The gas compression system of claim 6 wherein the electronic control module includes programming to simultaneously actuate the first and fourth electro-hydraulic valves simultaneously after deactivating the third electro-hydraulic valve on completion of the compression phase of the piston cycle phases.

8. The gas compression system of claim 6 wherein the electronic control module includes programming to deactivate the first and fourth electro-hydraulic valve on commencement of the expansion phase of the piston cycle phases.

9. The gas compression system of claim 1 having a gas dispensing means.

10. The gas dispensing system of claim 9 wherein the gas dispensing means is electronically connected to the electronic control module for selective dispensing of gas at the first pressure and the second pressure.

* * * * *